US005954143A

United States Patent [19]

McCabe et al.

[11] Patent Number: 5,954,143

[45] Date of Patent: Sep. 21, 1999

[54] REMOTE CONTROLLED ALL-TERRAIN DRILL UNIT

[76] Inventors: Howard Wendell McCabe, 6470 Pinecone Dr., Idaho Falls, Id. 83401; William Earnest McCabe, 1160 Stanger Ave., Idaho Falls, Id. 83404

[21] Appl. No.: 09/027,458

[22] Filed: Feb. 21, 1998

[51] Int. Cl.[6] ..... E21B 7/02

[52] U.S. Cl. ..... 173/184; 173/187; 173/189; 173/27; 173/171

[58] Field of Search ..... 173/184, 185, 173/187, 189, 27, 28, 171; 175/202, 203

[56] References Cited

U.S. PATENT DOCUMENTS

| | | | |
|---|---|---|---|
| 394,212 | 12/1888 | Saunders | 173/187 |
| 2,665,117 | 1/1954 | Ivey | 173/187 |
| 3,642,075 | 2/1972 | Willis | 173/189 |
| 4,172,615 | 10/1979 | Hakes | 173/27 |
| 4,303,130 | 12/1981 | Bonka | 173/28 |
| 4,363,519 | 12/1982 | Howard | 173/27 |
| 5,125,460 | 6/1992 | Behrens | 173/184 |
| 5,540,292 | 7/1996 | Behrens | 173/184 |
| 5,779,738 | 9/1998 | Kromray, Jr. | 173/189 |

*Primary Examiner*—Scott A. Smith
*Attorney, Agent, or Firm*—Risto A. Rinne, Jr.

[57] ABSTRACT

An apparatus adapted for maneuvering and drilling at least one hole at a site location is described as having an engine mounted in a supporting frame, at least part of the supporting frame including members that are adapted to contain a reservoir of fuel and a reservoir of hydraulic fluid, a hydraulic pump operatively attached to the engine, an electrical-hydraulic system operatively attached to the pump, and four extensible bi-directionally driven wheels along with a control panel that is adapted for remote use to control and to monitor the apparatus. A boom, capable of motion along a plurality of axes, is operatively attached and is adapted to receive a drill column or an accessory device, the accessory device being specifically designed to perform a special operation other than the direct drilling of a hole.

44 Claims, 6 Drawing Sheets

REMOTE CONTROLLED ALL-TERRAIN DRILL UNIT

BACKGROUND OF THE INVENTION

1. Field of the Invention

The present invention, in general relates to drilling machines and, more particularly, to all-terrain self-propelled drilling machines that are maneuverable and operable by remote control.

Drill units are used for a variety of purposes including core drilling, blast hole drilling, and surface grout hole drilling as well as to satisfy other special applications.

Sometimes the work environment presents cramped quarters where tight ninety-degree turns must be accomplished, such as is found in galleries at concrete water dams.

Sometimes steep inclines must be traversed including going up and down stairs or navigating up or down a steep incline for a prolonged period of time. This condition produces a potentially damaging condition to an engine in that the oil supply will congregate on one side of a steeply inclined internal combustion engine, possibly starving the oil sump of a reservoir of lubricating engine oil. Operating an engine at an angle where it is deprived of a continuous flow of lubricating oil can cause severe engine damage to occur, sometimes very quickly.

Similarly, hydraulic oil that is used to operate the hydraulic systems may not be available for use at a normal outlet location of a first side frame member tank if the tank is severely canted. This problem is exacerbated when some of the hydraulic oil is contained in one or more extended (or partially extended) hydraulic cylinders.

Certain operating environments may also present hazardous conditions for operation. Under such operating conditions it is desirable to be able to maneuver and also to operate the drill unit from a remote location. in some environments, toxic or noxious fumes may be present, such as may occur during certain grouting applications and in other situations which present or encounter these and other types of hazardous materials.

An especially acute danger for humans involves environments where higher than normal levels of radiation are present, such as those produced from the decay of radioactive isotopes. It is not safe for an operator to remain for prolonged periods of time in such locations. For some locations the danger may be so severe, because the radiation levels may be so high, that it is not wise to risk exposure for even short periods of time.

An example of such a situation involves the storage of nuclear waste. Nuclear waste is a by-product that arises from the operation of nuclear power plants and especially from nuclear weapons research and production. In particular, the nuclear waste related to nuclear weapons production is especially radioactive and therefore especially hazardous.

There are numerous locations in the United States (and also in other countries located throughout the world) where nuclear waste has been buried in underground storage tanks. In particular some of the nuclear waste from nuclear weapons production has been stored in either poorly designed or marginally designed storage tanks, and sometimes at poorly chosen site locations.

Examples of poor site selection for the storage of highly radioactive nuclear wastes include locations that are prone to geological activity, such as earthquakes, geothermal activity, or ground settling. An especially poor site selection is found where the earthen material that is disposed underneath or around the storage tank is porous. An especially poor site for the storage of nuclear waste is one that is disposed atop or near an aquifer. Perhaps the worst location would involve a storage tank that is disposed on porous soil leading to an aquifer.

During the "cold-war", compelled by the fear of foreign nuclear power superiority, surprisingly little consideration was given to such basic issues as mentioned above. Today, some of these storage tanks are known to be leaking highly radioactive nuclear waste into the soil that is disposed either under or around certain of the storage tanks. The problem thus created is immense.

There is a great danger that such leakage will eventually migrate a sufficient amount so as to reach an aquifer. Depending upon the particular radioactive isotopes that are leaking, contamination of an aquifer can potentially do an enormous amount of damage. This is because the water within the aquifer is moved according to the flow patterns that normally exist within the aquifer itself. These aquifer flow patterns are as capable of transporting pure water as they are of transporting radioactive contaminated water.

If an aquifer which supplies drinking or irrigation water is involved, there is an eminent danger present to all life forms which may either use or come in contact with radioactive contaminated water from the aquifer. Furthermore, the water consumption chain and also the various food chains are also impacted.

Crops and fields can become irradiated by radiation levels in the irrigation water, thereby posing a hazard to all life forms that may either pass by or graze on the crops or in the irradiated fields. The radiation can potentially be absorbed by the bodies of animals that either drink the radioactive water or graze upon the irradiated crops. Later, the contamination can be further spread along the food chain as these animals are themselves consumed by other animals disposed along the food chain, thus spreading the contamination in unpredictable ways.

Contamination can spread in other ways as well. If dairy cattle, for example, consume radioactive material, it can spread through their milk to their nursing young, and possibly even to humans. Accordingly, to stop this from occurring, large tracts of productive farm lands may become unusable for hundreds, or even thousands of years, and perhaps for even that many centuries by the radioactive contamination of even one key aquifer.

The potential human cost in terms of loss of life, physical and emotional suffering, and disease arising from the radioactive contamination of an aquifer is enormous. The environmental impact is nearly unimaginable. The economic costs are so high as to be almost incalculable.

If a polluted aquifer leaches into a river thus irradiating the river, the dangers and potential impacts are multiplied many fold. An entire swath of the river beginning at the point of contamination and extending down-river into the mouth of an ocean may be rendered both hazardous as well as sterile. The river itself can become too hazardous for any type of usage including its being used as a source of drinking water, irrigation water, and for recreational purposes. The magnitude of the disruption of life for countless generations is virtually unimaginable in some of the worst case scenarios that are currently being considered. Civilization, as it currently exists along such river banks, would be dramatically altered, even eliminated, if the river were to become contaminated with a highly radioactive waste.

In terms of environmental impact, perhaps one of the greatest and most imminent risks ever to confront life on this planet, comes from leaking storage tanks that contain radioactive substances. These substances include all manner of substances including solids, liquids, sludge, and even gases. Water that has been used in radioactive situations can itself become radioactive as the particulates within the water are themselves irradiated. Depending upon the particular variables affecting each storage location, the dangers associated with the spread of the nuclear waste material varies greatly.

The economic costs of containment at such installations are staggering and reach into the many billions of dollars. Certain of the proposals for achieving containment of leaking nuclear wastes, are themselves, uncertain as to efficacy. It is possible that billions of dollars can be spent toward such containment measures without achieving a lasting or satisfactory level of success.

One particularly promising approach is a form of surface grouting, a procedure which has a proven record of success in the containment of leaching substances, especially liquids. Grouting has been used to form a barrier to stop leaching as well as to stop leakage's. The size and shape of the barrier formed by surface grouting techniques is varied to establish a contour to match the application at hand.

The procedure is modified for storage tanks by drilling a series of holes around a leaking (or not yet leaking storage tank) so as to form a lattice of bore holes resembling a semi-sphere underneath the targeted storage tank. Then a grout, such as a urethane grout, is injected into the holes, preferably by long hole chemical grouting techniques as are taught by U.S. Pat. No. 5,342,149, to McCabe et al, that issued on Aug. 30, 1994, which is incorporated by reference herein.

Such an approach can be used to create a urethane (or other grout material) containment semi-sphere disposed underneath and around the targeted storage tank. The semi-sphere can be any desired diameter thus extending far enough away from a leaking storage tank so as to encompass any material which may have already leached into the soil under the tank. The barrier thus formed acts as a storage tank by and of itself. Of course, the shape of the urethane containment barrier can be other than a semi-sphere if desired.

A surface grouting approach as a means of containment relies upon proven technology with relatively minor changes and as such is likely to offer success. If desired the same approach can be utilized to create a plurality of urethane (or other grout material) containment hemispheres (or other shape), each one larger than the other and each one concentrically disposed with respect to the other. Such an arrangement can provide additional levels of protection for the most troublesome of locations. This approach offers a margin of safety, a fail-safe approach, toward the containment of radioactive wastes.

Such extremely hazardous working environments demand that the drill unit be both navigable and operable by remote control means. The background radiation levels in such locations may not allow for prolonged human operation of a drill unit near such nuclear waste types of storage tanks. Upon reaching the actual job site, which may be on the surface of the ground in proximity to a storage tank or in an access tunnel within the superstructure surrounding such a storage tank site, it is desirable to be able to remotely align the drill head in the proper position and accomplish as much of the drilling from a remote location as is possible without human assistance at the actual drilling site.

Depending upon the danger it may be possible for a human wearing protective clothing to enter the location for brief periods of time. Clearly a drill unit that can remotely reach a location and perform as much work as possible without an operator having to stand beside the unit is a useful device.

When drilling in radioactive locations, there is another danger that arises due to the hole that is being drilled in that it may open up a direct path to a highly radioactive source. If for example, hundreds of feet of earthen material or concrete or the like was separating an operator from a radioactive source, the mere drilling of a hole to the radioactive source removes that intervening barrier and exposes an operator to substantial risk at the drill site. In addition, any material that is extricated from the bore hole may be highly radioactive and contaminate the area adjacent to the drill site.

This does lend yet another advantage that is available through the use of surface grouting techniques for the containment of leakage's at nuclear waste storage sites. That is that such techniques often extricate core samples during the drilling process. These core samples can be studied for radioactive contamination and are therefore useful in determining the extent that radioactive wastes have leached into the soil. The exact locations of radioactivity can be "mapped " by studying the core samples, thus allowing for precise determination of the size, shape, and location or depth of the barrier that is required for containment.

However, the work environment that is in close proximity to the drill unit can be made especially hazardous during the actual drilling operation at a potentially radioactive site. This may occur without warning as one particular core sample can be especially radioactive once the drill has intersected with leaching radioactive material.

It is not always necessary to operate the drill unit from a great distance away. Lead or other types of shielding may be placed immediately around the drill unit forming a radioactive barricade, behind which, an operator may safely operate the drill unit.

This possibility is mentioned in that the distance separating an operator from a drill unit when it is being either maneuvered or operated in a radioactive environment need not be excessive, but rather merely sufficient to ensure the safety of the operator. Under such conditions, the ability to operate the drill unit from only a short distance away can nevertheless be especially valuable.

This requires that a good deal of information be made available remotely. For example the location of the drill unit must be known at all times as well as the condition of all of its systems. In the event of a malfunction, it must be possible to send in another unit and remotely connect it with a malfunctioning unit in order to retrieve the crippled unit.

Other types of tanks can, similarly, be leaking potentially dangerous substances. For example petroleum, in its many forms, can also do considerable damage to the earthen material that it comes into contact with as it leaks from a storage tank. It can also cause enormous environmental damage by leaching into an aquifer. Although the hazards may be less severe than those present in radioactive environments, it is still advantageous to be able to use surface grout injection technology, as mentioned above, as a method for containing such types of leakage's. It is desirable to be able to perform containment operations from a remote location whenever it is deemed to be either hazardous of when the potential to become hazardous exists at the site itself.

Accordingly there exists today a need for a drill unit that can navigate in cramped quarters, ascend steep inclines, prevent engine damage from a lack of lubricating oil from occurring, and be maneuvered, operated, and monitored remotely.

Clearly, such an apparatus is a useful and desirable device.

2. Description of Prior Art

Drill units are, in general, known. For example, the following patents describe various types of these devices:

U.S. Pat. No. 3,470,968 to Melsheimer et al, that issued on Oct. 7, 1969;

U.S. Pat. No. 3,642,075 to Wills, that issued on Feb. 15, 1972;

U.S. Pat. No. 4,172,615 to Hakes, that issued on Oct. 30, 1979;

U.S. Pat. No. 4,303,130 to Bonca, that issued on Dec. 1, 1981;

U.S. Pat. No. 4,363,519 to Howard, that issued on Dec. 14, 1982;

U.S. Pat. No. 4,501,199 to Mashimo et al, that issued on Feb. 26, 1985; and

U.S. Pat. No. 4,508,035 to Mashimo et al, that issued on Apr. 2, 1985.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a remote controlled all-terrain drill unit that can be maneuvered from a remote location.

It is also an important object of the invention to provide a remote controlled all-terrain drill unit that can be operated from a remote location.

Another object of the invention is to provide a remote controlled all-terrain drill unit that can be monitored from a remote location.

Still another object of the invention is to provide a remote controlled all-terrain drill unit that can be maneuvered in cramped quarters.

Still yet another object of the invention is to provide a remote controlled all-terrain drill unit that can traverse steep inclines.

Yet another important object of the invention is to provide a remote controlled all-terrain drill unit that can climb and descend stairs.

Still yet another important object of the invention is to provide a remote controlled all-terrain drill unit that can prevent engine damage due to a lack of lubricating oil from occurring when ascending or descending steep inclines.

Still yet another very important object of the invention is to provide a remote controlled all-terrain drill unit that can be used for core drilling.

Still yet another especially important object of the invention is to provide a remote controlled all-terrain drill unit that can be used for blast hole drilling.

Still yet one other important object of the invention is to provide a remote controlled all-terrain drill unit that can be used for surface grout hole drilling.

One further object of the invention is to provide a remote controlled all-terrain drill unit that can be used in hazardous environments.

Another important further object of the invention is to provide a remote controlled all-terrain drill unit that can be used in radioactive environments.

Still yet one more important object of the invention is to provide a remote controlled all-terrain drill unit that can retrieve a crippled unit when operated from a remote location.

Still yet one more very important object of the invention is to provide a remote controlled all-terrain drill unit that can drill a hole in any direction at a given site location.

Briefly, a remote controlled all-terrain drill unit apparatus that is constructed in accordance with the principles of the present invention has an engine mounted in a supporting and protective frame, a hydraulic pump operatively attached to the engine, an electrical-hydraulic system operatively attached to the pump that supplies motive power for the hydraulically operated component parts of the drill unit, a first side frame member which provides both structural support and functions as a reservoir to contain hydraulic fluid and a second side frame member which also provides structural support and is adapted to contain a fuel, a plurality of extensible wheels each of which are bi-directionally driven, and a boom adapted to receive a drill head. As desired, it also includes controls which allow for the remote monitoring, maneuvering, and operation of the drill unit.

DETAILED DESCRIPTION OF THE INVENTION

Figure 1:
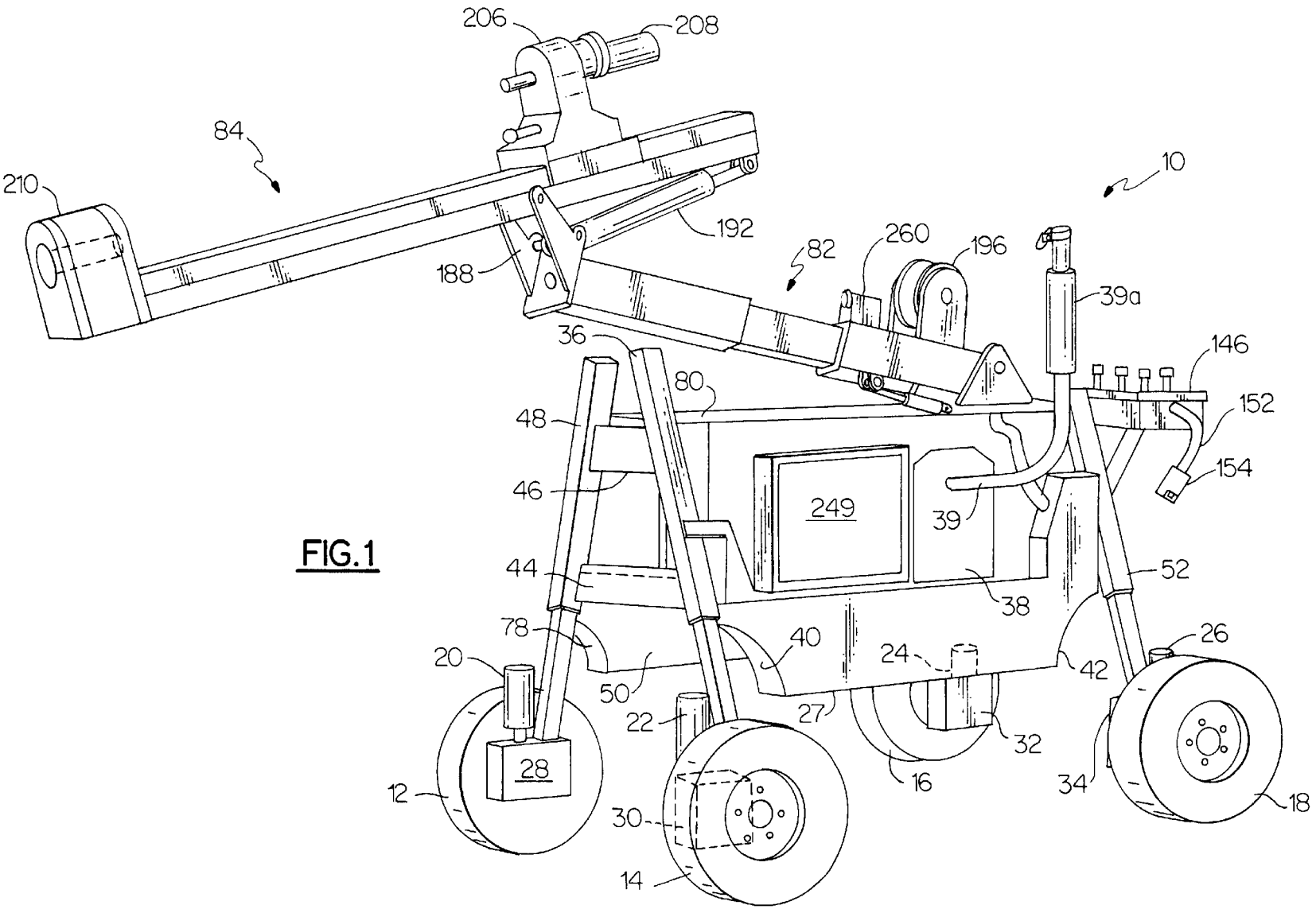
FIG. 1 is a view in perspective of a remote controlled all-terrain drill unit. The hydraulic hoses and certain of the hydraulic cylinders are omitted from this view as their operation, when viewed in conjunction with the description found in the specification, is understood by those skilled in the art, and also because such omission provides greater clarity of the remaining component parts of the drill unit.

Referring to FIG. 1 is shown, a remote controlled all-terrain drill unit, hereinafter referred to as a drill unit, and identified in general by the reference numeral 10.

Throughout this specification, certain component parts of the drill unit 10 are described as being attached to other component parts. Such attachment is accomplished by whatever method is preferred, such as by welding or by the use of fasteners (not shown) including, but not limited to, the use of a bolt (not shown) and a nut (not shown). These are design choices that those of ordinary skill are able to select from amongst accordingly and unless there is a special consideration no further mention as to the particular method that is used for attachment is included.

Similarly the material used for construction of the various component parts of the drill unit 10 is a design choice that can be varied according to the particular requirements. While steel is a common material used for the construction of the drill unit 10, alternative materials, such as aluminum or titanium may, for example, be used when reducing weight is a desirable object.

The drill unit 10 includes four driven wheels one disposed at the front right, another disposed at the front left, another disposed at the rear right and the remaining one disposed at the rear left, each of which is identified respectively by the reference numerals, 12, 14, 16, and 18.

One of four hydraulic motors, each of which is identified respectively by the reference numerals, 20, 22, 24, and 26, is used to power each of the four driven wheels 12, 14, 16, 18. Each of the four hydraulic motors 20, 22, 24, 26 is able to turn in either a forward or a reverse direction and to do so independent of the motion exhibited by the motors on the opposite side.

That is to say the front right hydraulic motor 20 and the rear right hydraulic motor 24 together move in unison and independent with respect to the motion of the front left hydraulic motor 22 and the rear left hydraulic motor 26. The front left hydraulic motor 22 and the rear left hydraulic motor 26 also move in unison and independent with respect to the motion of the front right hydraulic motor 20 and the rear right hydraulic motor 24.

The hydraulic hoses are omitted from this view to improve clarity of the construction of the drill unit 10. As is well known in the art, two hoses must be attached to each of the hydraulic motors 20, 22, 24, 26, one supplying hydraulic fluid (not shown) under pressure, and the other forming a return line to carry the hydraulic fluid back to a first side frame member 27 which also functions as a hydraulic fluid reservoir, as described in greater detail hereinbelow.

A worm-gear drive is attached to each of the hydraulic motors 20, 22, 24, 26 as identified by the respective reference numerals 28, 30, 32, 34. Each worm-gear drive 28, 30, 32, 34 is attached respectively to each of the four driven wheels 12, 14, 16, 18 and each is used to transfer power from one of the hydraulic motors 20, 22, 24, 26 to one of the four driven wheels 12, 14, 16, 18.

A significant advantage provided by the use of the worm gear drives, 28, 30, 32, 34, is that they also supply a means for braking. It is the nature of a worm gear to resist motion when the driven gear attempts to rotate as it cannot drive the worm gear. Accordingly, when there is no hydraulic fluid being supplied under pressure to any of the hydraulic motors 20, 22, 24, 26, the worm gear drives, 28, 30, 32, 34, prevent the rotation of any of the respective four driven wheels 12, 14, 16, 18 from occurring.

When the direction of motion of any of the four hydraulic motors 20, 22, 24, 26 is desired to be reversed, the supply and return lines change function. What was the supply line under pressure becomes the return line and what was the return line becomes the supply line under pressure. When the hydraulic fluid under pressure enters the hydraulic motor 20, 22, 24, 26 from the opposite side of the motor, the motor rotates in the opposite direction. Accordingly the four driven wheels 12, 14, 16, 18 are capable of bi-directional rotation.

If the front left hydraulic motor 22 and the rear left hydraulic motor 26 in unison are used to rotate in a forward direction both the front left driven wheel 14 and the rear left driven wheel 18 while the front right hydraulic motor 20 and the rear right hydraulic motor 24 are not used, the drill unit 10 will make a right hand turn whilst dragging and skidding the front right driven wheel 12 and rear right driven wheel 16.

If instead, the front right hydraulic motor 20 and the rear right hydraulic motor 24 are used to rotate in a reverse direction both the front right driven wheel 12 and the rear right driven wheel 16, the drill unit 10 will make a very sharp right hand turn, essentially turning over an imaginary point (not shown) disposed underneath the drill unit 10 and near the geometric center thereof.

Accordingly, the drill unit can be utilized to make very tight radius turns which is useful for maneuvering in tight or cramped quarters, such as in corridors where a ninety-degree right hand turn is required. Conversely by applying motive power to the front right hydraulic motor 20 and to the rear right hydraulic motor 24 so as to rotate in a forward direction both the front right driven wheel 12 and the rear right driven wheel 16 whilst simultaneously the front left hydraulic motor 22 and the rear left hydraulic motor 26 are used to rotate in a reverse direction both the front left driven wheel 14 and the rear left driven wheel 18, a sharp left hand turn can be accomplished.

Any radius right or left hand turn is possible by momentarily turning the drill unit 10 in the desired direction, and then turning it an additional amount as required. A combination of turning and dragging any of the four driven wheels 12, 14, 16, 18 is useful for negotiating any type of a situation that involves making a turn that may be encountered during use of the drill unit 10.

Of course if all of the four hydraulic motors 20, 22, 24, 26 are forced to turn in the same direction to the same extent, linear motion is exhibited by the drill unit 10 in either a forward or a reverse direction, depending upon the direction the four hydraulic motors 20, 22, 24, 26 are urged to rotate.

It has been shown how the drill unit 10 can be maneuvered around curves, and in either a forward or reverse direction. The drill unit 10 is ideally suited for use on steep inclines or stairs because each of the four driven wheels 12, 14, 16, 18 are extensible as is also shown in greater detail in FIG. 2.

A first outer rectangular tube 36 forms one of four such component parts which, together and with other component parts of the drill unit 10 which are to be described in greater detail hereinafter, form a supporting frame assembly.

The supporting frame assembly supports the weight of an internal combustion engine, identified by the reference numeral 38, as well as the weight of the other component parts of the drill unit 10. an exhaust pipe 39 and muffler 39*a* are attached to the engine 38. If desired an electric motor (not shown) or other source of motive power could be used in place of the engine 38. However, for most applications, the engine 38 is an effective source of power to operate the drill unit 10, as is described in greater detail hereinbelow.

The first outer rectangular tube 36 is attached to the first side frame member 27 by an intermediate gusset plate 38. The first side frame member 27 is formed of rectangular steel tubing that includes a radius 40 formed at one end thereof that is adapted to receive the front left driven wheel 14.

The telescoping action by which the front left driven wheel 14 is extensible and retractable is described in greater detail hereinbelow. However, when the front left driven wheel 14 is fully retracted, the radius 40 allows for additional retraction of the front left driven wheel 14. This occurs because the radius of the front left driven wheel 14 and the radius of the first side frame member 27 are similar, thus permitting the front left driven wheel to retract close to the radius 40 in the first side frame member 27. This allows for an even greater range of extension and retraction to occur, as is discussed hereinbelow, and it also serves to make the drill unit 10 as compact as possible when all of the driven wheels 12, 14, 16, 18 are fully retracted. In particular the width of the drill unit, when all of the driven wheels 12, 14, 16, 18 are fully retracted, is typically less than four feet wide.

A second radius 42 is formed in the first side frame member 27 at an opposite end with respect to the radius 40. The second radius 42 is adapted to receive the rear left driven wheel 18 in a manner similar to that as described above for the radius 40.

A lower member 44 and an upper member 46 are also attached at a first end thereof to the first outer rectangular tube 36 at a lower and oppositely disposed upper location of the first outer rectangular tube 36, respectively. The lower member 44 and the upper member 46 are both disposed perpendicular with respect to the first side frame member 27.

The lower member 44 and the upper member 46 are each attached at a second end thereof that is disposed opposite with respect to the first end to a second outer rectangular tube 48. The second outer rectangular tube 48 is disposed at an angle with respect to the first outer rectangular tube 36 so that the top portions of the first and the second rectangular tubes 36, 48 are closer to each other than are the bottom portions of the first and the second rectangular tubes 36, 48. This arrangement is useful for improving the stability of the drill unit 10 and is described in greater detail hereinbelow.

A second side frame member 50 is disposed parallel with respect to the first side frame member 27 and on the opposite side of the drill unit 10. The second side frame member 50 is formed similar to that of the first side frame member 27 and is attached at one end thereof to the second outer rectangular tube 48 similar to the way in which the first side frame member 27 is attached to the first outer rectangular tube 36.

As the four driven wheels 12–18 are capable of rotating is either direction, either end of the drill can, if desired be considered to be the front. To aid in the understanding of the drill unit 10, for the purpose of describing its construction, it is viewed as having a front and a rear, and therefore of going either forwards or backwards. The first and the second rectangular tubes 36, 48, which are each disposed on an opposite side of the drill unit 10, are considered for the purpose of this specification to be in the front portion of the drill unit 10.

A similar pair, comprised of a third outer rectangular tube 52 and a fourth outer rectangular tube (not shown) that are disposed on opposite sides of the drill unit 10 and in a similar angular relationship with respect to each other as are the first and the second rectangular tubes 36, 48, are disposed at the rear of the drill unit 10.

The second side frame member 50 is attached at a remaining end thereof to the fourth outer rectangular tube. The first side frame member 27 is attached at a remaining end thereof to the third outer rectangular tube 52. A second lower member (not shown) and a second upper member (not shown) are each attached at opposite ends thereof to the third outer rectangular tube 52 and to the fourth outer rectangular tube in a manner similar to that which the lower member 44 and the upper member 46 are each attached to the first and second outer rectangular tubes 36, 48.

Together, the first and second outer rectangular tubes 36, 48, the first and second side frame members 27, 50, the third 52 and fourth outer rectangular tubes, the lower member 44 and the upper member 46, and the second lower member and a second upper member, form a supporting frame assembly for the drill unit 10.

The frame assembly supports the weight of the engine 38 and all other component parts of the drill unit 10, with of course the exception of those component parts that are supported by the surface over which the drill unit 10 is placed, such as the four driven wheels 12–18, for example.

Figure 2:
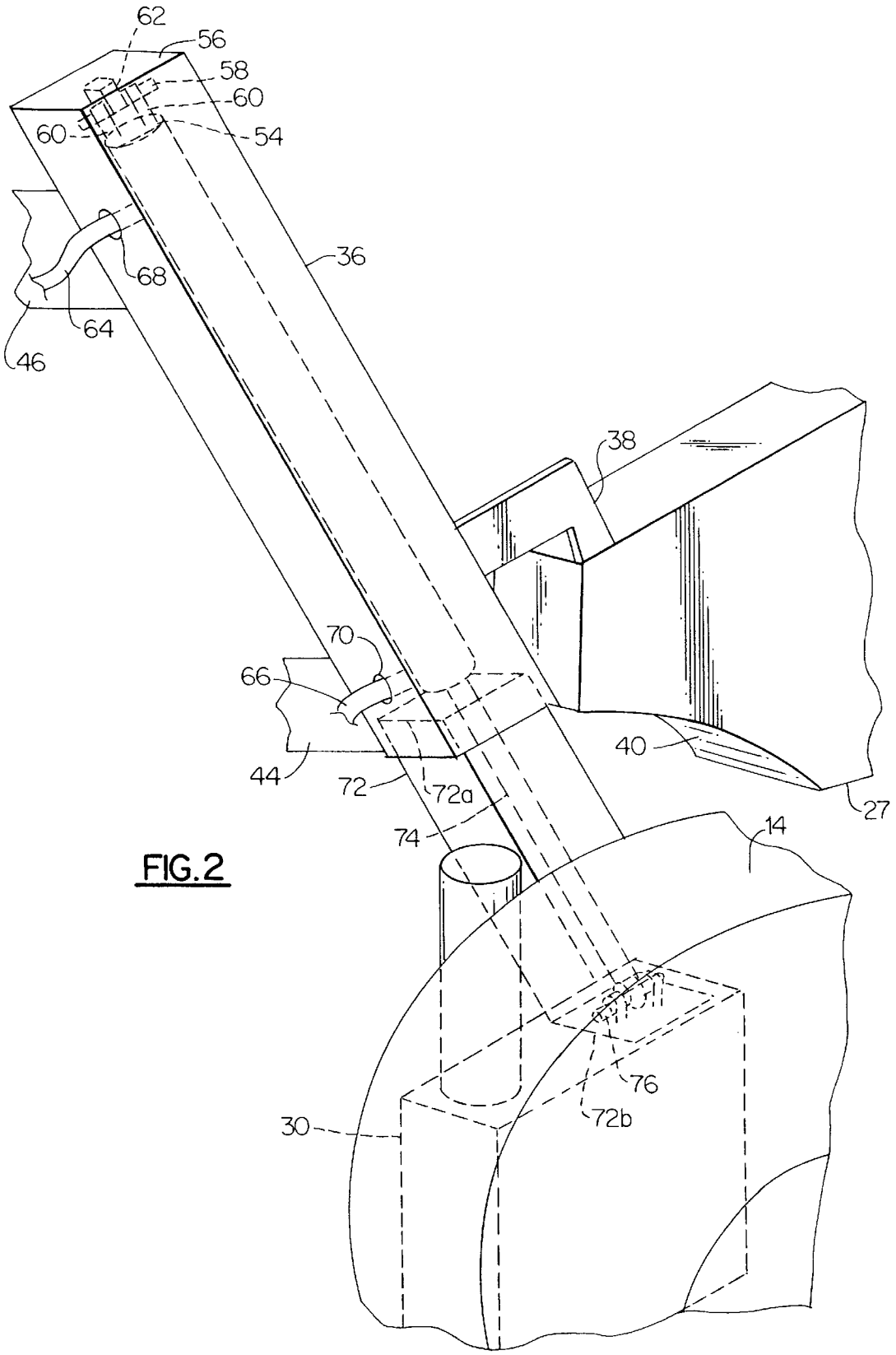
FIG. 2 is an enlarged view in perspective of a telescoping driven wheel assembly as shown in FIG. 1.

Referring now in particular to FIG. 2, is shown in detail construction of first outer rectangular tube 36 and assembly of various component parts attached thereto. The description which follows shows additional detail that is absent the FIG. 1 view for the first outer rectangular tube 36 as well as for the second, third, and fourth outer rectangular tubes 48, 52, all of which are similarly constructed.

A first hydraulic cylinder 54 is shown in dashed lines disposed within the first outer rectangular tube 36. The first hydraulic cylinder 54 is attached at the top thereof to a top member 56, which is attached to the top of the first outer rectangular tube 36. Any method of attachment of the first hydraulic cylinder 54 to the top member 56 is anticipated. As shown a clevis pin 58 passes through a hole (not shown) of a pair of members 60 that are attached to the top of the first hydraulic cylinder 54 and also through a second hole (not shown) formed through an appendage 62 that is attached to the top member 56.

A first hydraulic fluid supply line 64 and a second hydraulic fluid supply line 66 are each attached to the main body of the first hydraulic cylinder 54 at opposite ends thereof and function alternatively as either the supply or return lines, as was generally discussed earlier. The first hydraulic fluid supply line 64 and the second hydraulic fluid supply line 66 each pass through respective outer holes 68, 70 that are formed in the first outer rectangular tube 36.

An extensible first inner rectangular tube 72, having outer dimensions that are less than the inner dimensions of the first outer rectangular tube 36, is adapted to slidably fit within the first outer rectangular tube 36 so that it can be extended or retracted therein in a telescopic, or extensible, manner. An upper end 72*a* of the first inner rectangular tube 72 is disposed at all times, even during maximum extension, within the first outer rectangular tube 36.

In order to be able to fully retract the first inner rectangular tube 72, it must also be able to pass over the main body of the first hydraulic cylinder 54, which is selected so as to have an outer diameter that is less than the inside dimensions of the first inner rectangular tube 72.

An extensible rod 74 is operatively attached to the first hydraulic cylinder 54 and is extended or retracted therefrom in accordance with the flow of hydraulic fluid to and from the first hydraulic cylinder 54. A lower end 72*b* of the first inner rectangular tube 72 is disposed at an opposite end thereof with respect to the upper end 72*a*. The lower end 72*b* is attached to one of the worm-gear drives 30. The end of the extensible rod 74 is, in turn attached to either the worm-gear drive 30 or to the lower end 72*b* of the first inner rectangular tube 72. As shown, a second clevis pin 76 is used attach the extensible rod 74 to the worm-gear drive 30 similar to the matter by which the clevis pin 58 is used to attach the top of the first hydraulic cylinder 54 to the top member 56.

Accordingly, as the extensible rod 74 is either extended or retracted from the first hydraulic cylinder 54, the first inner rectangular tube 72, the worm-gear drive 30, the hydraulic motor 22, and the front left driven wheel 14 also simultaneously extend either away from or retract closer toward the first outer rectangular tube 36.

The first outer rectangular tube 36, the first inner rectangular tube 72, the first hydraulic cylinder 54 and extensible rod 74, the first hydraulic fluid supply line 64 and the second hydraulic fluid supply line 66, the worm-gear drive 30, the hydraulic motor 22 (and its hydraulic fluid supply lines), and the front left driven wheel 14, and points of attachment as described hereinabove, together, form a first extensible wheel assembly.

The second 48, third 52, and fourth outer rectangular tubes are each similarly constructed so as to provide a second, third, and fourth extensible wheel assembly. As any of the extensible wheel assemblies are, for example extended, the affected corner of the drill unit 10 is raised further above the surface. This is useful to stabilize the drill unit 10 during operation. If the surface is not perfectly flat, then any of the extensible wheel assemblies may be either extended or retracted so as to provide a stable platform for positioning of the drill unit 10.

The extensible wheel assemblies are especially useful in maneuvering the drill unit up or down steep inclines. A steep incline cants the engine 38 which can adversely affect the availability of the fluid that is used for lubrication of the engine as well as the availability of the hydraulic fluid that is used for operation of the hydraulic components of the drill unit 10. It can also adversely affect access to the fuel that is used to power the engine 38.

For example, if the drill unit 10 is to proceed forward down a steep incline, or down a flight of stairs, the extensible wheel assemblies can always be used to mitigate these effects and, in many cases, to ameliorate them entirely. As the drill unit 10 begins to descend the front pair of extensible wheel assemblies, including the first outer rectangular tube 36 and the second outer rectangular tube 48, are extended or alternatively, the rear pair of extensible wheel assemblies are retracted, or both are accomplished simultaneously, depending of course upon the severity of the incline and the preference of the operator (not shown). Either way, the intention is to maintain the drill unit 10 in as level an attitude as is possible.

The above description applies equally well when the drill unit 10 is ascending either a steep incline or a flight of stairs, except that the forward pair of extensible wheels are retracted while the rear pair of extensible wheels are extended to maintain the drill unit 10 in as level an attitude as possible, thus permitting operation for prolonged periods of time when the drill unit 10 is disposed on an inclined surface, or on stairs.

It is mentioned, as an aside, that the second side frame member 50 functions as a reservoir for the fuel to operate the internal combustion engine 38. Because of low volatility, this is usually diesel fuel, and the engine 38 normally operates from diesel fuel, however it could be gasoline, or any other type of fuel as desired.

The interior space of the first side frame member 27 and the second side frame member 50 are intentionally selected to serve as these fluid reservoirs in order to provide as compact a drill unit 10 as is possible. If the fuel and hydraulic fluid were stored in an additional reservoir (not shown), this would only add bulk to the size of the drill unit 10.

The first side frame member 27 and the second side frame member 50 are selected to provide sufficient structural strength to support the drill unit 10 and also to provide sufficient fluid capacity, as desired. Of course, the utility of both the first side frame member 27 and the second side frame member 50 can be reversed, if desired, where the first side frame member 27 functions as a fuel reservoir and the second side frame member 50 functions as a hydraulic fluid reservoir.

With regard to any of the extensible wheel assemblies, of course, there must be enough slack provided in the hydraulic fluid lines (not shown) which alternatively supply hydraulic fluid under pressure and also function as a return line for the hydraulic motor 22 to allow the hydraulic motor 22 to extend to the maximum amount as is allowed by the stroke length of the first hydraulic cylinder 54. As mentioned earlier, when fully retracted the front left driven wheel 14 is in close proximity to the radius 40 formed in the first side frame member 27.

A third radius 78 and a fourth radius (not shown) are formed in opposite ends of the second side frame member 50, similar to the way in which the second radius 42 is formed in the first side frame member 27 at an opposite end with respect to the radius 40. This allows for the maximum retraction of any of the four driven wheels 12–18.

It is also important to note that when the four driven wheels 12–18 are extended, the space separating oppositely disposed wheels, such as driven wheel pairs 12 and 14, and driven wheel pairs 16 and 18, increase. This results in a wider support base for the drill unit 10 when any of the four driven wheels 12–18 are extended, thus improving stability of the drill unit 10.

Conversely, when retracted the wheel spacing is minimal thus allowing the drill unit 10 to negotiate in narrow confines. The extensible wheel assemblies each include one of the four driven wheels 12–18, and therefore provide full time four wheel drive capabilities for the drill unit 10 in either a forward or a reverse direction. This is, of course, useful when either ascending or descending steep inclines or going up or down stairs as well as when maneuvering the drill unit 10 over surfaces having poor traction, such as either wet or snow covered surfaces.

A top plate 80 is attached near to the top of each of the four outer rectangular tubes 36, 48, 52 (the remaining is not shown) at a location that is generally disposed above the engine 38. The top plate 80 serves as a platform for an operating boom assembly, identified in general by the reference numeral 82.

A drill column assembly, identified in general by the reference numeral 84, is attached to the boom 82, and is described in greater detail hereinafter. The drill column 84 must be positionable where desired, at virtually any angle with respect to the drill unit 10 in order to drill any desired hole. The operating boom 82, in unison with the drill assembly 84, provide the necessary range of motions to position the drill column 84 as required, and are each described in greater detail hereinbelow.

Figure 3:
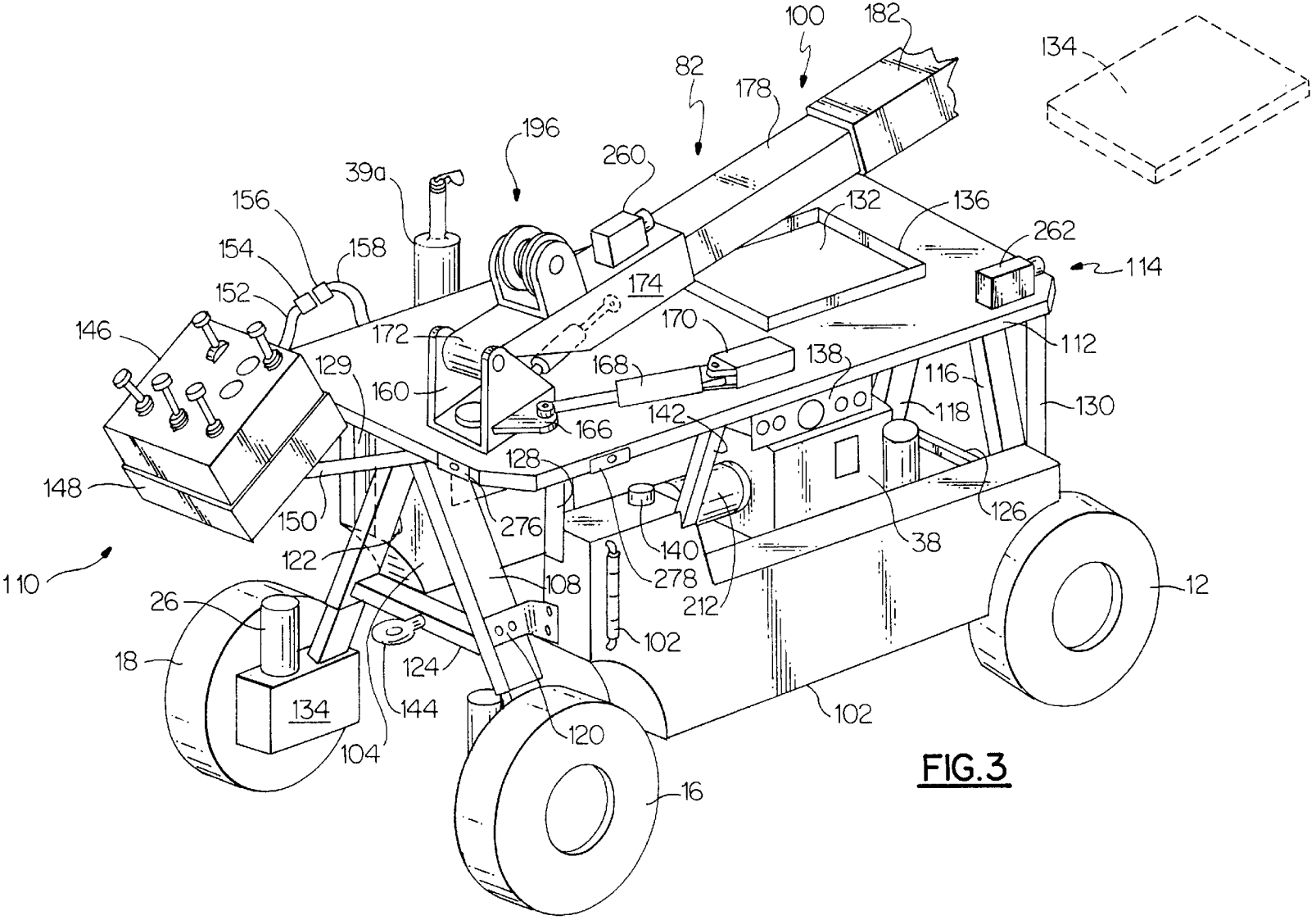
FIG. 3 is a view in perspective of a remote controlled all-terrain drill unit having a modified frame assembly that provides a more compact, maneuverable, and easier to service unit.

Referring now in particular to FIG. 3, is shown a modified drill unit, identified in general by the reference numeral 100. The modified drill unit 100 includes a hydraulic reservoir tank 102, a fluid level indicator 103, and a similar fuel tank 104 that is disposed on the opposite side of the modified drill unit 100 as is the hydraulic reservoir tank 102. The hydraulic reservoir tank 102 and the fuel tank 104 are constructed of rectangular steel tubing and form structural components of a modified frame assembly as is described in greater detail hereinafter.

A pair of rear extensible jacks 106, 108 are included at the rear end 110 of the modified drill unit 100, each of which are constructed similar to that described for each of the extensible wheel assemblies as describe above for the drill unit 10, except that the positioning of the rear jacks 106, 108 is such that they terminate under a modified top plate 112.

For construction details for each of the rear jacks 106, 108 refer momentarily to FIG. 2 as they are identical, except for any differences in size and between the type of attachment to the drill unit 10 as compared to the modified drill unit 100. Each of the rear jacks 106, 108 also includes components similar to the first outer rectangular tube 36, the first inner rectangular tube 72, the first hydraulic cylinder 54 and extensible rod 74, the first hydraulic fluid supply line 64 and the second hydraulic fluid supply line 66, the worm-gear drive 30, the hydraulic motor 22 (and its hydraulic fluid supply lines), and the front left driven wheel 14, as was described regarding the FIG. 2 embodiment.

A front end 114 of the modified drill unit 100 is disposed at an end opposite with respect to the rear end 110. A second pair of front jacks 116, 118 are disposed at the front end 114 of the modified drill unit 100 and are constructed similar to the rear jacks 106, 108.

A first bracket 120 is used to attach the end of the hydraulic reservoir tank 102 disposed at the rear end 110 to one of the rear jacks 108. A second bracket 122 is similarly used to attach the rear end 110 portion of the fuel tank 104 to the remaining one of the rear jacks 106. A third and a fourth bracket (not shown) are similarly used to attach the remaining ends of both the fuel tank 104 and the hydraulic reservoir tank 102 to the front jacks 116, 118 that are disposed at the front end 114 of the modified drill unit 100.

A rear cross member 124 is attached near the bottom intermediate the rear jacks 106, 108. A front cross member 126 similarly is attached to both of the front jacks 116, 118 and intermediate with respect thereto.

The outer rectangular tubes of the rear jacks 106, and 108 along with the rear cross member 124 form a triangular structure with the top of the triangle supporting, as mentioned above, the rear end of the modified top plate 112. The front jacks 116, 118 similarly form a triangle, the top of which supports the front of the modified top plate 112.

Disposed over the first bracket 120 and attached at one end to the hydraulic reservoir tank 102 at the top thereof and at the remaining end to the modified top plate 112 is a first rear support member 128. The support member 128 provides additional support for the modified top plate 112. A second rear support member 129 is similarly disposed between and also attached to the top of the fuel tank 104 and the modified top plate 112 at the opposite side of the modified drill unit 100 as compared to the first rear support member 128.

A first front support member 130 is similarly disposed and attached intermediate the hydraulic reservoir tank 102 and the modified top plate 112 near the front end 114 of the modified drill unit 100. A second front support member (not shown) is similarly disposed and attached intermediate the fuel tank 104 and the modified top plate on the opposite side of the modified drill unit 100.

Together, the hydraulic reservoir tank 102, the fuel tank 104, the outer rectangular tubes of the rear jacks 104, 106 and the front jacks 116, 118, the rear cross member 124, the front cross member 126, the first bracket 120, the second bracket 122, the third and the fourth brackets, the first rear support member 128, the second rear support member 129, the first front support member 130, the second front support member, and the modified top plate 112, together, form a supporting modified frame assembly for the modified drill unit 100.

The principle advantage of the design of the modified frame assembly of the modified drill unit 100 is that is provides a compact unit that is well suited for use in cramped areas. Another advantage includes providing ample support for the modified top plate 112 and therefore for the boom assembly 82 and the drill column 84. Another advantage is that structural rigidity is provided with few component parts. A further advantage is that better, more open access to the engine 38 is provided. (It is noted that identical component parts of the drill unit 10 and the modified drill unit 100 are identified by the use of identical reference numerals.)

A principle advantage of the supporting frame assembly of the drill unit 10, as described in the first embodiment, is that the extensible wheel assemblies can be made of any length as desired, which makes the drill unit 10 especially suitable for use with extremely steep inclines. Of course if it were desired to maintain the easy access features of the modified drill unit 100, and to also have longer extensible wheel assemblies, then it would be possible to combine the teachings of the drill unit 10 and the modified drill unit 100 by changing the angle of the modified extensible wheel assemblies so that they are of longer length and extend above the modified top plate 112 while still utilizing the remaining component parts of the modified frame assembly of the modified drill unit 100.

Access is further enhanced by an opening 132 that is provided in the modified top plate 112 which makes routine servicing, such as checking and adding engine oil, easier to accomplish. A cover plate 134 is shown in dashed lines disposed to the right of the opening 132. The cover plate 134 fits over a lip 136 which surrounds the opening 132.

A panel of gauges 138 attached to the bottom of the modified top plate 112 indicate the operating parameters of the engine 38. A first cap 140 allows for both venting and the adding of hydraulic fluid to the hydraulic reservoir tank 102. A second cap (not shown) that is attached to the fuel tank 104 allows for the addition of fuel to the fuel tank 104.

A first intermediate support member 142 is attached at one end to the hydraulic reservoir tank 102 and at the remaining end to the modified top plate 112. The first intermediate support member 142 is disposed intermediate the first rear support member 128 and the first front support member 130. A similar second intermediate support member (not shown) that is disposed on the opposite side of the modified drill unit 100 is attached to the fuel tank 104 and to the modified top plate 112. The first intermediate support member 142 and the second intermediate support member provide additional support to the modified top plate 112, and greater rigidity to the overall modified drill unit 100. They can also be included in the component list of the supporting frame assembly of the modified drill unit 100.

A tow ring 144 is attached to the rear cross member 124 and is useful to tow an object (not shown). If necessary the tow ring 144 can be used to tow an inoperative drill unit (not shown). A second tow ring (not shown) or, alternatively, a spring loaded hook assembly (not shown) is attached to the front cross member 126, as desired. The spring loaded hook assembly is designed to latch onto the tow ring 144 of the inoperative drill unit, and is useful for remote operation, as is described in greater detail hereinbelow.

A control panel 146 rests atop a platform 148, the platform 148 being attached to the modified drill unit 100 by a platform bracket 150. A first cable 152 is attached to the control panel 146 and includes a connector plug 154. The plug 154 may either connect directly to the drill unit 100 where desired, or may connect to a mating plug 156 that is attached to a second cable 158, the second cable 158 being attached where desired to the drill unit 100. The functions of the control panel 146 are described in greater detail hereinbelow.

Figure 5:
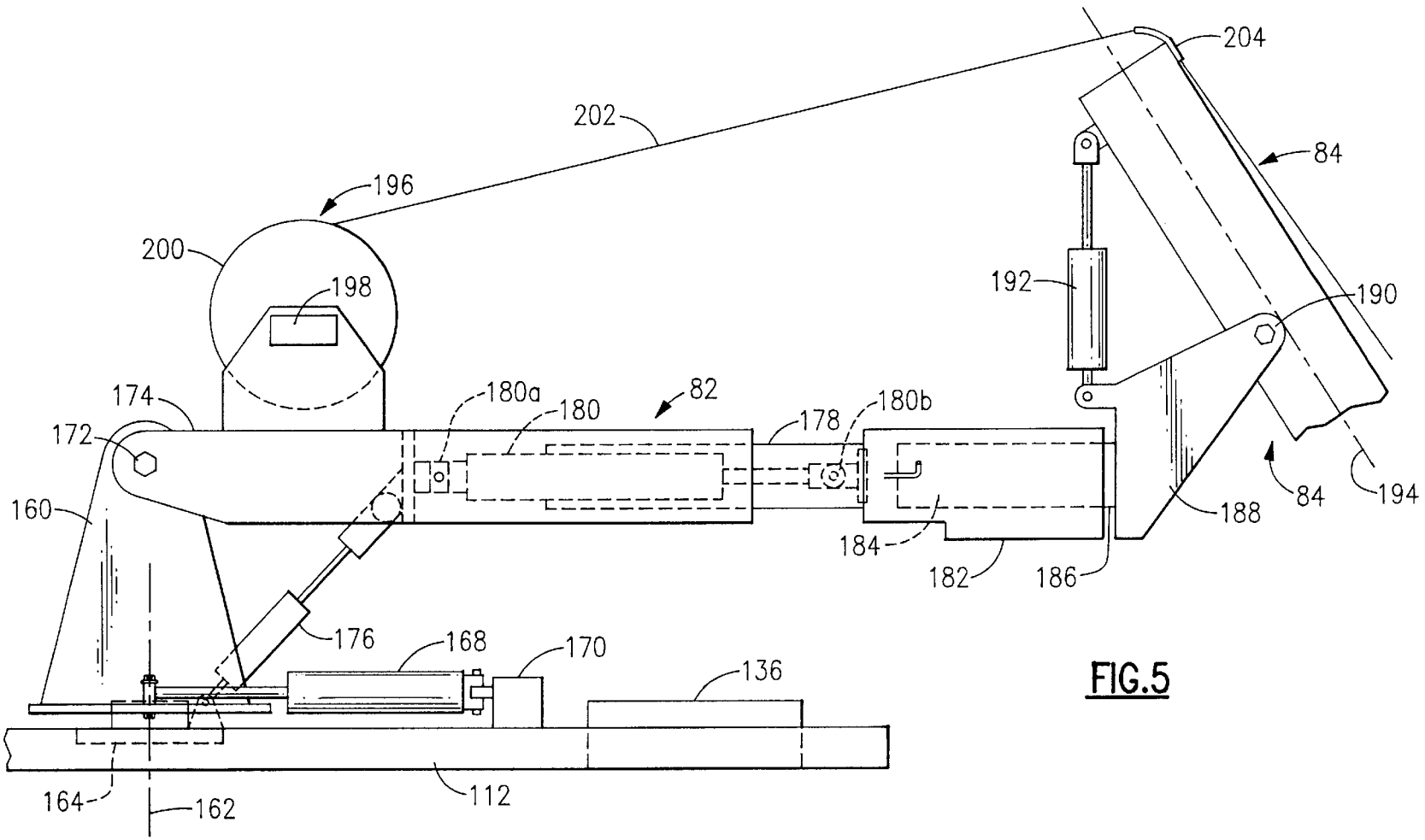
FIG. 5 is a side view of the boom assembly.

Referring also on occasion to FIG. 1 and to FIG. 5 is shown the boom assembly 82. The description which follows refers specifically to the boom 82 as attached to the modified drill unit 100, and of course is applicable for use when attached to the drill unit 10 as well.

A base assembly, identified by the reference numeral 160, is pivotally attached about a first axis 162 to the modified top plate 112. The first axis 162 is shown in FIG. 5 as an imaginary vertical dashed line passing through the modified top plate 112. A pivot bearing 164 is attached to the modified top plate 112 and to the bottom portion of the base assembly 160 and provides load bearing for the boom 82 and also allows for the boom 82 to pivot around the first axis 162.

The base assembly 160 includes a side plate 166 attached thereto that is adapted for pivotal attachment to one end of a swing hydraulic cylinder 168. The remaining end of the swing cylinder 168 is pivotally attached to a mounting block 170 that is, in turn, attached to the modified top plate 112. Extension and retraction of the swing cylinder 168 will cause the side plate 166 to move further away and closer to the block 170, respectively, thus rotating the base assembly 160 about the first axis 162. This motion, in relation to the boom 82, is referred as "swing".

Disposed at the top of the base assembly 160 at an end that is opposite with respect to the pivot bearing 164, is a second axis which runs through the center of a tilt pin 172. A first boom member 174 is pivotally attached to the base assembly 160 by the tilt pin 172. A tilt hydraulic cylinder 176 is pivotally attached at one end thereof to the first boom member 174 and to the base assembly 160 at the remaining end thereof.

Extension and retraction of the tilt hydraulic cylinder 176 causes the first boom member 174 to pivot about the second axis into a position that is generally further away from the modified top plate 112 and closer to the modified top plate 112, respectively. This motion of the boom assembly 82 is called "tilt " and it involves the up and down motion of the boom 82 with respect to the modified drill unit 100. The tilt cylinder 176 is attached to the base assembly 160 so that as the boom 82 swings, the tilt cylinder 176 follows the base assembly 160 as it rotates around the first axis 162 during swing.

An second boom member 178 is adapted to fit inside of the first boom member 174 and is adapted to extend from the first boom member 174 and also to retract within the first boom member 174 in accordance to the extension and retraction exhibited by an extension hydraulic cylinder 180. The second boom member 178 must therefore have outside dimensions that are less than the inside dimensions of the first boom member 174. The extension hydraulic cylinder 180 is shown in dashed lines in the FIG. 5 drawing. It is attached at a first end 180*a* to the first boom member 174 and at an opposite second end 180*b* to the second boom member 178. This motion is referred to as "extension " of the boom 82.

A third boom member 182 is attached to the second boom member 178 at an end of the second boom member 178 that is disposed furthest away from the end of the second boom member 178 that is adapted to fit inside of the first boom member 174. The third boom member 182 is adapted to receive a hydraulic twist actuator 184 therein. The actuator 184 is shown in the FIG. 5 drawing in dashed lines. Hydraulic twist-type of actuators, in general, allow for a limited range of bi-directional rotary motion to occur. Typically they allow up to a maximum of about 360 degrees of rotary motion, or one full circle of twist to occur and may be stopped and positioned anywhere within the entire range of rotary motion that they allow. They are also known as "pivot actuators " and an example of one such unit suitable for use as the hydraulic twist actuator 184 is product model number "10K " having 360 degrees rotation, produced by HELAC corporation.

The actuator 184 is attached to the third boom member 182 and includes a rotating shaft 186 that extends from the third boom member 182 and to which is attached a drill housing assembly 188. The drill housing assembly 188 is capable of rotary motion about a third axis that is parallel with a longitudinal axis of the boom 82 and which passes through the center of the actuator 184. The rotary motion of the drill housing assembly 188 is limited to about 360 degrees of back and forth rotation of which the drill housing assembly 188 can be stopped and positioned anywhere within this range of motion, as desired. This motion is referred to as "twist " and it is used to twist the drill column 84 as desired.

The drill column 84 is attached to the drill housing assembly 188 along a fourth axis passing through a second pivot pin 190. The fourth axis is perpendicular with respect to the third axis. The second pivot pin 190 is disposed in the drill housing assembly 188 at an end thereof that is opposite where the actuator 184 is attached. A drill pivot hydraulic cylinder 192 is pivotally attached at one end thereof to the drill housing assembly 188 and to the drill column 84 at the remaining end thereof. Extension and retraction of the drill pivot cylinder 192 causes the drill column 84 to pivot about the fourth axis with respect to the drill housing assembly 188. This motion is referred to as "pivot " of the drill column 84.

A drill column axis 194 represents a longitudinal axis passing through the drill column 84. The drill column axis 194 is parallel with respect to any hole that is bored by the drill column 84. It is essential that either the drill unit 10 or the modified drill unit 100 be maneuverable so that the drill column axis 194 of the drill column 84 can be aligned with any hole that is desired to be bored.

The swing, tilt, extension, twist, and pivot capabilities of the drill unit 10 and modified drill unit 100 allow for the drilling of any hole in any direction away from the drill unit 10 or the modified drill unit 100. An imaginary sphere (not shown) can be envisioned around the drill unit 10 or the modified drill unit 100 with the drill unit 10 or the modified drill unit 100 positioned at the origin of that sphere. The drill column 84 is able to align itself with all possible radii emanating from the origin of that sphere. This increases the utility of the drill unit 10 or the modified drill unit 100 by being able to drill a hole in any possible direction from a site location.

A winch, identified in general by the reference numeral 196 is attached to the first boom member 174 and includes a hydraulic winch motor 198 that is used to rotate in either direction a spool 200. A winch line 202 is wound around the spool 200 and passes over a shiv 204 that is attached to the drill column 84 when desired. The shiv 204 directs the winch line 202 where desired about the drill column 84. The winch 196 is used for extraction of a drill rod (not shown) from a bored hole (not shown).

Referring in particular to FIG. 1 again, the drill column 84 includes a drill motor 206 that is slideably attached to the drill column 84 and is capable of longitudinal motion along the drill column axis 194. A drill advance hydraulic cylinder (not shown) is disposed in the drill column 84 and is used to urge the drill motor 206 longitudinally along the drill column 84.

The drill motor 206 is hydraulically operated (operated by a hydraulic motor 208) and is detachably attached to the drill column 84. Accordingly other types of motors (not shown) can be attached as desired to the drill column 84. Certain types of motors are better suited for particular drilling operations. For example a down-hole hammer is a particular type of motor that can be attached to the drill column 84 and for which air is the circulation media. Alternatively a coring motor for obtaining core samples is also adaptable for use with the drill column 84 and for which is the circulation media. Any type of a motor may be attached to the drill column and may be powered hydraulically, by compressed air, or even electrically, if desired. The use of such motors and their attachment to the drill column 84 are well known by those having ordinary skill in the art.

A clamp 210 is shown attached to the end of the drill column 84 that is generally disposed at the opposite end with respect to where the drill pivot hydraulic cylinder 192 is attached. The clamp 210 includes any of a variety of possible clamps (not shown) depending upon the application, including a nipple clamp which attaches to a structure about the drill hole and is useful to align the drill column 84 with the drill hole, as well as a hydraulically operated pipe clamp which is useful to secure a drill string (not shown) when additional length must be either added or removed from the drill string. The clamp 210 is detachably attached to the drill column 84 and is varied as desired for the particular application at hand.

Referring again to all of the FIGURE drawings, and in particular to FIG. 3 is shown hydraulic pump 212 operatively attached to the engine 38. Engine 38 rotation is used to operate the hydraulic pump 212, which in turn supplies hydraulic fluid under pressure to the various hydraulic component parts of the drill unit 10 and the modified drill unit 100.

Figure 6:
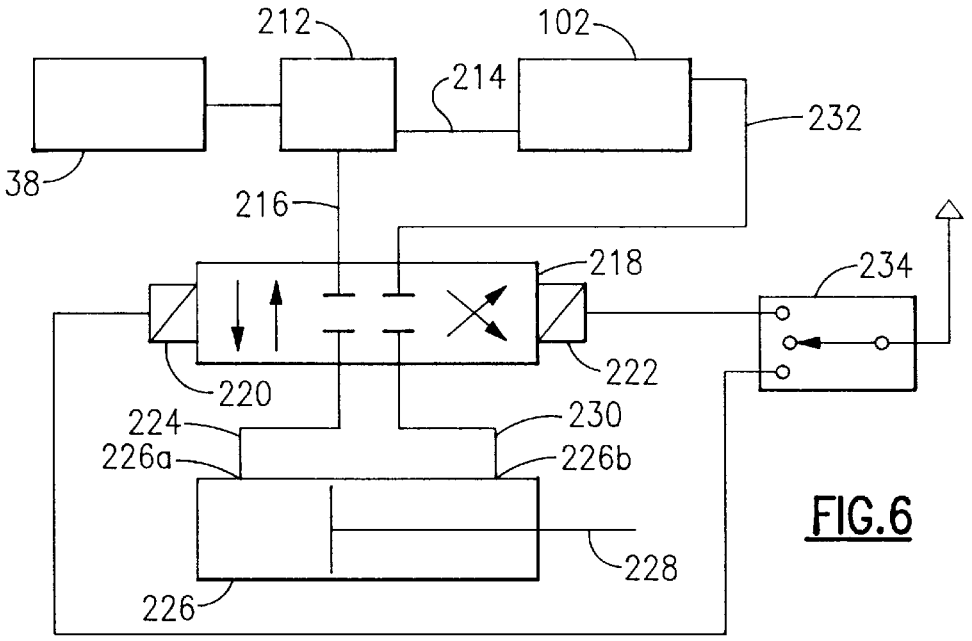
FIG. 6 is a block diagrammatic view which shows the basic operation of a limited portion of the hydraulic system of the drill unit.

Referring now also to FIG. 6, is shown a simplified view of the basic hydraulic control system for either the drill unit 10 or the modified drill unit 100. The engine 38 is operatively attached to the pump 212 which draws in hydraulic fluid through an intake line 214 that is attached to the hydraulic reservoir tank 102.

Hydraulic fluid exits under pressure from the pump 212 into a pressure outlet line 216 and flows to a bi-directional control valve 218. A pair of solenoids 220, 222 determine the position and therefore the flow of fluid through the valve 218. A relief valve is not shown and is well known as a method to bypass the valve 218 when neither solenoid 220, 222 is energized, as are other methods well known in the hydraulic arts.

When solenoid 220 is energized hydraulic fluid flows straight through the valve 218 and under pressure into a first line 224 which supplies fluid under pressure to a first port 226*a* of a hydraulic cylinder 226. The hydraulic cylinder 226 represents any of the hydraulic cylinders or hydraulic motors of either the drill unit 10 or the modified drill unit 100. This forces a rod 228 to extend from the cylinder 226 and for hydraulic fluid to exit out of a second port 226*b* of the cylinder 226 and to flow back to the valve 218 through a second line 230, through the valve 218 and out into a return line 232 which returns the fluid back to the hydraulic reservoir tank 102, thus completing the hydraulic circuit.

Conversely, when solenoid 222 is energized hydraulic fluid flows diagonally through the valve 218 and under pressure into the second line 230 and into the second port 226b where the rod 228 is retracted into the cylinder 226. Hydraulic fluid exits from the first port 226*a* of the cylinder 226 and flows back into the valve 218, diagonally across the valve 218 and exits into the return line 232 which returns the fluid back to the hydraulic reservoir tank 102.

The valve 218 is an electric-hydraulic valve meaning its functioning is electrically controlled by supplying an electrical voltage (signal) to either of the solenoids 220, 222. The valve 218 is either a full-on, full-off type of configuration or is a proportional valve to control not only the direction of flow of the hydraulic fluid, but to proportionally control the quantity of fluid flowing therein depending upon the relative positioning of a control switch 234. The control switch 234 represents any of the function switches (as is discussed in greater detail hereinbelow) found on the control panel 146.

Figure 4:
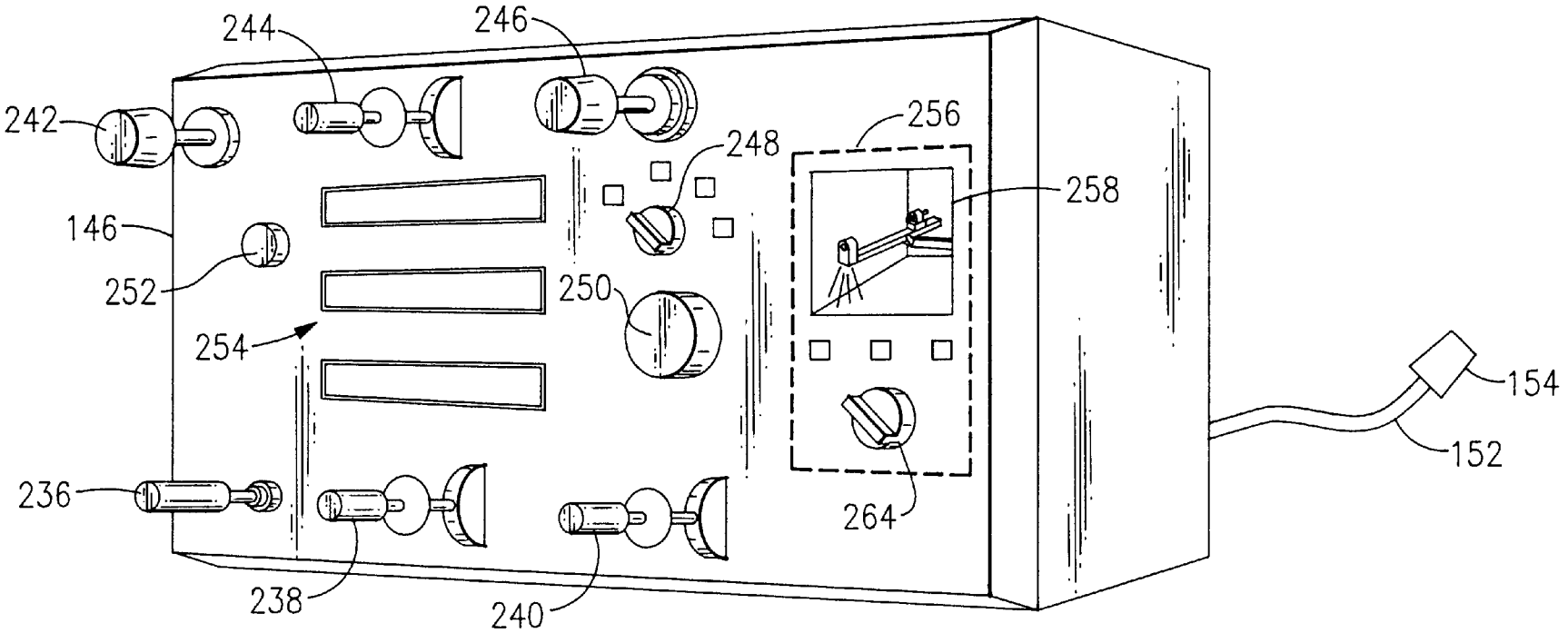
FIG. 4 is a view in perspective of a control panel of the drill unit.

Referring in particular to FIG. 4, the control panel includes a plurality of function switches, identified by the reference numerals 236, 238, 240, 242, 244, and 246. The functions that are controlled by any of the function switches 236, 238, 240, 242, 244, 246 vary depending upon the position a mode switch 248 is set to.

The mode switch 248 is shown as having any of four possible settings which generally affect the operation of all of the function switches 236, 238, 240, 242, 244, 246. The four positions are drill, drive, boom, and off. In the drill position the function switches 236, 238, 240, 242, 244, 246 generally control operations relating to drilling operations, such as feed (advancing the motor 206 on the drill column 84). The drive position generally relates to operation of the four hydraulic motors 20, 22, 24, 26 and the jacks 106, 108, 116, 118. The boom position controls positioning of the boom assembly 82 and the off position renders the function switches 236, 238, 240, 242, 244, 246 inoperative at present and may be used as desired for any future modality.

The first function switch 236 is used to advance the drill motor 206 in the drill mode and to supply power to the left motors 22, 26 in the drive mode. The other switches are set as desired. The use of the mode switch 248 allows each of the function switches 236, 238, 240, 242, 244, 246 to perform multiple functions thus reducing their number accordingly.

A switch panel 249 is shown in FIG. 1 attached to the drill unit 10 and is used for switching purposes to control which of the valves (not shown) are affected by which of the function switches 236, 238, 240, 242, 244, 246 depending upon the positioning of the mode switch 248. The switch panel 249 is contained on the drill unit 10 to perform the mode shifting rather than on the control panel 146 to reduce the electrical connections which flow through the first cable 152.

An emergency kill switch 250 can stop operation in an emergency or it may be used for other functions as desired as can an additional switch 252 such as to start (crank) the engine 38. An information panel 254 supplies any relevant and desired information, such as hours of engine 38 operation, fluid levels, fluid pressures, engine 38 operating parameters, or whatever is desired.

A television monitor panel 256 is contained within a dashed outline to indicate that all such monitoring capabilities are optional depending upon the requirements of the drill unit 10 or the modified drill unit 100. The monitor panel 256 includes a television monitor 258 which shows the images that are scanned by any of a plurality of television cameras 260, 262 (See FIG's 1 and 3). Additional television cameras (not shown) may be positioned where desired on the drill unit 10 or on the modified drill unit 100 to augment the remote monitoring capabilities. The cameras 260, 262 are generally of the closed circuit type and are well known to those familiar with surveillance systems. The cameras 260, 262 are useful to monitor the drill unit 10 or the modified drill unit 100 and the environment as it performs any desired operation including navigation to and from a work site.

Accordingly, a camera selector switch 264 is useful to select from amongst the television cameras 260, 262 the image that is desired for viewing. This monitoring capability is especially useful when the drill unit 10 or the modified drill unit 100 must be operated remotely or in hazardous environments where it is desirable to limit human exposure.

Figure 7:
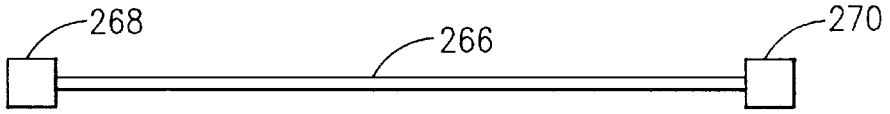
FIG. 7 is a side view of an extension cable used for remote operation of the drill unit.

Referring now also to FIG. 7 is shown an extension cable 266 which includes a first extension connector 268 that is operatively connectable to the connector plug 154 and a second extension connector 270 that is operatively connectable to the mating plug 156. The extension cable 266 can be used to provide an extension to allow use of the control panel 146 at any predetermined distance away from the drill unit 10 or the modified drill unit 100. This also augments remote operation of the drill unit 10 or the modified drill unit 100, and the extension cable 266 is designed to contain electrical cables for all of the function switches 236, 238, 240, 242, 244, 246, the mode switch 248, the emergency kill switch 250, the additional switch 252, the information panel 254, and the television cameras 260, 262.

Figure 8:
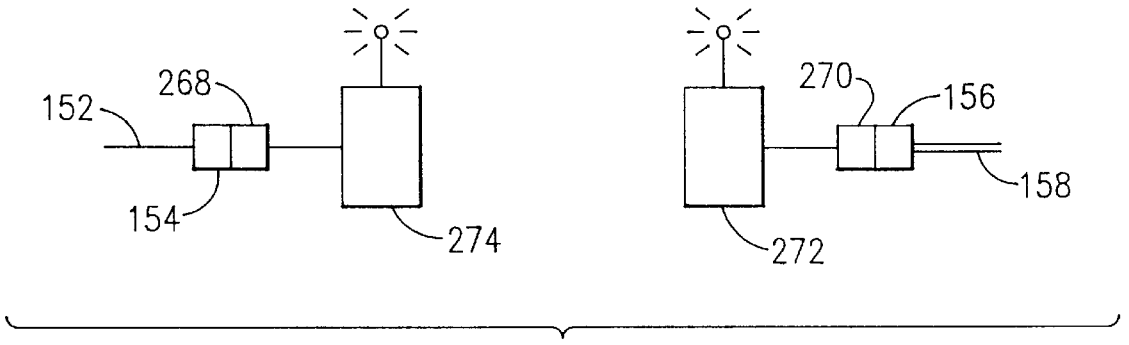
FIG. 8 is a block diagrammatic view of an alternative pair of radio transceivers used for remote operation of the drill unit.

Referring to FIG. 8, is shown a pair of radio transceivers 272, 274, each operating on a compatible frequency or on a pair of compatible frequencies so as to allow bi-directional communication therebetween. Any electromagnetic frequency or method of modulation of information upon a carrier frequency that is suitable for operation therebetween is acceptable, as is well known in the radio communication arts.

Each transceiver 272, 274 must be able to convert all of the information supplied by the first cable 152 and the second cable 158 respectively into a format suitable for radio transmission and reception. The use of a microprocessor (not shown) and analog to digital hardware (not shown) is anticipated for inclusion into each of the transceivers 272, 274. Where it is desirable to have no physical connection between the control panel 146 and the drill unit 10 or the modified drill unit 100, the use of the pair of radio transceivers 272, 274 provides a solution providing such operation is accomplished within the effective communication range of the transceivers 272, 274.

An optional first level 276 and an optional second level 278 are mounted to the top plate 112 of the modified drill unit 100. The first level 276 indicates level along a first plane which traverses from one side to the other of the modified drill unit 100. The second level 278 indicates level along a second plane which is disposed perpendicularly with respect to the first plane and traverses alone an imaginary longitudinal axis of the modified drill unit 100 extending from the front end 114 to the rear end 110 thereof. The first level 276 and the second level 278 provide either a visual indication (for an operator to see) or a sensor to translate level information into a form that can be communicated over the first cable 152 and the second cable 158 for remote display on the control panel 146.

OPERATION:

In use either the drill unit 10 or modified drill unit 100 is fueled and started adjacent to an operator. If the environment is not hazardous and the operator is to accompany either the drill unit 10 or modified drill unit 100 to the site, the mode switch 248 on the control panel 146 is set to drive mode and the function switches 236, 238, 240, 242, 244, 246 are manipulated by the operator to maneuver the drill unit 10 or modified drill unit 100 into position, using the jacks 106, 108, 116, 118 (using the modified drill unit 100 as an example) to maintain the modified drill unit 100 in as level an attitude as possible for as much of the time as possible.

Upon reaching the work site, the mode switch 248 is changed to boom and the boom 82 and drill column 84 are properly oriented.

The mode switch 248 is then set to drill and the motor 206 is advanced as desired to drill the hole in accordance with the type of hole that is to be drilled. The winch 196 is used as required. Additional drill rods are added if necessary, core samples are extracted, and the drilling operation is accomplished.

If surface grouting is required, then the hole is treated as described in U.S. Pat. No. 5,342,149, to McCabe et al, that issued on Aug. 30, 1994 and grout is accordingly injected therein.

The process is repeated for as many holes as are required. Then the above described procedure for reaching the site location is reversed and the modified drill unit 100 (or the drill unit 10) is removed from the site along with the operator.

It is important to note that the control panel 146 is not attached to either the drill unit 10 or to the modified drill unit 100. It rests in place on top of the platform 148 so that the operator can walk behind either of the units 10, 100 while operating the various function switches 236, 238, 240, 242, 244, 246, as desired.

The control panel 146, as it is not attached to the drill unit 10, 100 nor is the operator encased within the drill unit 10, 100, provides remote control capability even when it is left resting upon the unit 10, 100. If it is instead preferred, the operator can lift the control panel 146 off of the platform 148 and carry it, either in his hands or in another vehicle (not shown), while he directs the functioning of either of the units 10, 100 from a remote location with respect thereto.

The distance the operator is away from either of the drill units 10, 100 is the only variable that affects remote operation and it depends upon the combined length of the first cable 152 and the second cable 158. Therefore anytime the control panel 146 is used this is, in effect, accomplishing remote control of the unit 10, 100. The only question is from how far away is this to occur and this is initially determined by the length the first cable 152 and the second cable 158. If this length is deemed insufficient for the application at hand this effective length can be increased by the use of the extension 266 which is added intermediate the first cable 152 and the second cable 158.

When the operator is not to accompany the drill unit 10 or the modified drill unit 100 to the site, then the control panel 146 is separated apart from the drill unit 10 or the modified drill unit 100 by either the extension 266 or by the use of the transceivers 272, 274 and the above described navigational and functional drilling operations are accomplished by remote control via the control panel 146.

The length of the extension 266 is limited only by the signal strength through the wires (not shown) that are contained within the extension 266 and within the first cable 152 and the second cable 158. Normally great distances, up to thousands of feet of remote operation, can be accomplished by the use of a sufficient length of extension 266.

If there is significant background noise (electrical, magnetic, or radioactivity) then either the maximum working distance is reduced or shielding techniques, such as are well known in the electrical signal transfer arts, are utilized. For example the first cable 152, second cable 158, and the extension 266 can include an electrical shield (not shown) which surrounds the wires therein, the shield being electrically grounded at either the drill unit 10 or at the modified drill unit 100. If desired, at least one electrical shielding plate (not shown) can be added to either the drill unit 10 or to the modified drill unit 100 to block and absorb electromagnetic energy and conduct it to ground before it affects operation of either of the units 10, 100.

Sometimes, the distance from the actual site need not be excessive in order to provide additional protection for an operator. For example, if the drill unit 10 or modified drill unit 100 are utilized in a radioactive environment where core sample extraction's may be dangerous to the operator but the normal background level of radiation is not excessive, it may be possible for the operator to position himself behind shielding, such as a lead liner (not shown), that is placed relatively close to either of the units 10, 100. The remote control and monitoring capabilities of the drill unit 10 and the modified drill unit allow for great flexibility in their use.

The exact switching means have not been specified to allow for design choice. For example, relays are effective as are solid state semi-conductors for performing any of the switching and electrical and electric-hydraulic control functions of either the drill unit 10 or the modified drill unit 100, as is a combination of the above. Semi-conductors are advantageous for use when subject to vibration whereas relays are preferable for use in environments where strong electro-magnetic signals are present (which decrease the signal to noise ratio) or where radiation is present which can rapidly degrade certain semi-conductors.

If additional functions must be performed remotely, which the drill unit 10 or the modified drill unit 100 are not presently adapted for, then a specially modified drill unit (not shown) is provided that is adapted for use with a specialized accessory (not shown) that is designed so as to perform the required function and also to fit on either the boom 82, the drill housing assembly 188, or on the drill column 84 itself.

The intention is that the drill unit 10 or the modified drill unit 100 can serve as an operating platform which can be modified to perform any function that is required to be accomplished remotely. This is possible because the boom 82, the drill housing assembly 188, and the drill column 84 have versatile capabilities to move along many planes of motion and to pivot about a number of axes simultaneously, thus allowing an operator exact control over their positioning. Furthermore, the hydraulic capabilities of the drill unit 10 and the modified drill unit 100 allow for the actuation of additional hydraulic devices (not shown) which can grasp and release objects as desired.

These proposed accessory devices can be designed and adapted by those having ordinary skill in the art and from the benefit of these teachings to fit on the boom 82, the drill housing assembly 188, or the drill column 84. The ability to manipulate an additional hydraulic device where desired that can grasp and release objects when desired provides great versatility for either the drill unit 10 or the modified drill unit 100 to function as a remote controlled operating platform.

Thus by using a plurality of drill units 10, modified drill units 100, and specially modified drill units, virtually all remote navigation and drilling functions can be accomplished by remote control using the control panel 146 for both the control of these functions and for monitoring the environment as they are accomplished.

The cameras 260, 262 are useful for remote monitoring purposes and as mentioned hereinabove, additional cameras may be used and positioned wherever desired. To select the image that is seen on the television monitor 258, the camera selector switch 264 setting is changed, as desired, to select from amongst the television cameras 260, 262 or from any other additional cameras that may be used. If preferred, at least one special camera (not shown) can be adapted for placement on one of the specially modified drill units, the primary purpose being that of providing a remote monitoring platform.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A remote controlled all-terrain drill unit, comprising:

(a) a supporting frame assembly including a member that is adapted to contain a reservoir of fuel and including a member that is adapted to contain a reservoir of hydraulic fluid;

(b) an engine attached to said supporting frame assembly;

(c) a hydraulic pump operatively attached to said engine;

(d) a hydraulic system operatively attached to said hydraulic pump;

(e) a plurality of extensible wheels attached to said drill unit, each of said extensible wheels adapted to telescope into a greater length and to retract into a lesser length with respect to a longitudinal length thereof; and (f) a boom operatively attached to said drill unit, said boom adapted for movement about an axis with respect to said drill unit.

2. The drill unit of claim 1 wherein each of said plurality of extensible wheels includes a hydraulic motor attached thereto, said motor adapted to rotate each of said wheels.

3. The drill unit of claim 2 wherein each of said plurality of extensible wheels is adapted for bi-directional rotation by said motor.

4. The drill unit of claim 3 wherein each of said plurality of extensible wheels that is adapted for bi-directional rotation is cooperatively paired to rotate a simultaneous amount in the same direction with another of said plurality of extensible wheels that is disposed on the same side of said drill unit independent with respect to each of said plurality of extensible wheels that are disposed on the opposite side of said drill unit.

5. The drill unit of claim 1 wherein said hydraulic system includes means for controlling the functions of said drill unit.

6. The drill unit of claim 5 wherein said means for controlling includes at least one valve operatively attached to said hydraulic system, said valve adapted to control the flow of a fluid therein.

7. The drill unit of claim 6 including a plurality of valves.

8. The drill unit of claim 6 wherein the operation of said valve is controlled by an electrical signal applied thereto.

9. The drill unit of claim 8 wherein the operation of said electrical signal is controlled by at least one switch.

10. The drill unit of claim 9 wherein said at least one switch is disposed on a control panel, said control panel including means for interfacing said control panel with said valve.

11. The drill unit of claim 10 wherein said means for interfacing includes an electrical cable.

12. The drill unit of claim 11 wherein said electrical cable includes a pair of electrical connectors intermediate thereto, said pair of electrical connectors providing means for disconnecting said control panel from said drill unit.

13. The drill unit of claim 12 including an extension, said extension adapted for mechanical and electrical connection to each of said pair of electrical connectors whereby said extension provides means to extend the operative distance said control panel is operatively attached to said drill unit.

14. The drill unit of claim 1 including a detachable control panel, said control panel includes means for controlling the operational parameters of said drill unit.

15. The drill unit of claim 14 wherein said control panel includes means for communication with said drill unit, said means for communication adapted for use of said control panel at a predetermined distance away from said drill unit.

16. The drill unit of claim 15 wherein said means for communication includes an electrically conductive cable.

17. The drill unit of claim 15 wherein said means for communication includes at least one electrically conductive extension cable that is adapted for use with said electrically conductive cable.

18. The drill unit of claim 15 wherein said means for communication includes a pair of radio transceivers, one of said pair of radio transceivers operably attached to said control panel and the remaining one of said pair of radio transceivers operably attached to said drill unit.

19. The drill unit of claim 1 wherein said each of said extensible wheels is disposed at an angle with respect to each of said extensible wheels that is disposed on the opposite side of said drill unit whereby the distance separating said each of said extensible wheels from said each of extensible wheels that is disposed on the opposite side increases when either of said disposed extensible wheels is urged to extend further and decreases when either of said disposed extensible wheels is urged to retract.

20. The drill unit of claim 1 wherein said member that is adapted to contain a reservoir of fuel includes a radius formed in at least one end thereof, said radius adapted to correspond with and to receive at least one of said extensible wheels, whereby said at least one of said extensible wheels is thereby adapted to further retract along said longitudinal axis.

21. The drill unit of claim 1 wherein said member that is adapted to contain a reservoir of hydraulic fluid includes a radius formed in at least one end thereof, said radius adapted to correspond with and to receive at least one of said extensible wheels, whereby said at least one of said extensible wheels is thereby adapted to further retract along said longitudinal axis.

22. The drill unit of claim 1 including at least one camera attached thereto.

23. The drill unit of claim 22 wherein said at least one camera is a closed circuit television camera that is adapted for transmission of an image through an electrical conduit.

24. The drill unit of claim 22 wherein said at least one camera is adapted for radio-transmission of a television image.

25. The drill unit of claim 22 including a control panel that is adapted for display of an image produced by said at least one camera.

26. The drill unit of claim 25 wherein said control panel includes switching means for the alternative display of an image when said at least one camera includes a plurality of cameras.

27. The drill unit of claim 1 including a winch, said winch attached to said boom.

28. The drill unit of claim 27 wherein said winch includes a hydraulic motor attached thereto adapted for urging a spool of said winch to rotate about an axis in either direction.

29. The drill unit of claim 28 including a winch line and a shiv attached to said boom, said shiv adapted to guide said winch line with respect to a drill column that is attached to said boom.

30. The drill unit of claim 1 including a drill column that is attached to said boom.

31. The drill unit of claim 30 wherein said drill column includes a drill motor wherein said drill motor is detachably attached thereto and adapted for motion along a longitudinal axis of said drill column.

32. The drill unit of claim 31 wherein said drill motor is a down-hole hammer.

33. The drill unit of claim 31 wherein said drill motor is a coring motor.

34. The drill unit of claim 30 including a clamp attached to said drill column.

35. The drill unit of claim 33 wherein said clamp is a nipple clamp.

36. The drill unit of claim 33 wherein said clamp is operated by hydraulic means.

37. The drill unit of claim 35 wherein said clamp is a pipe clamp.

38. The drill unit of claim 1 including a top plate disposed above said frame assembly.

39. The drill unit of claim 38 wherein said top plate includes an opening therein, said opening adapted for servicing of said drill unit.

40. The drill unit of claim 39 wherein said boom is pivotally attached to said top plate.

41. The drill unit of claim 39 wherein said a top of extensible wheels extends beyond the top of said top plate.

42. The drill unit of claim 39 wherein a top of said extensible wheels terminates at a location that is disposed below said top plate.

43. A remote controlled all-terrain drill unit, comprising:

(a) a supporting frame assembly:

(b) an engine attached to said supporting frame assembly;

(c) a hydraulic pump operatively attached to said engine;

(d) hydraulic means operatively attached to said hydraulic pump;

(e) a plurality of extensible wheels attached to said drill unit, each of said extensible wheels adapted to telescope into a greater length and to retract into a lesser length with respect to a longitudinal length thereof;

(f) a hydraulic reservoir attached to said supporting frame assembly;

(g) a fuel reservoir attached to said supporting frame assembly; and (h) a boom operatively attached to said drill unit, said boom adapted for movement about an axis with respect to said drill unit.

44. The drill unit of claim 43 wherein each of said extensible wheels is a component of said supporting frame assembly.

* * * * *